US008118510B1

(12) United States Patent
Kamhi

(10) Patent No.: US 8,118,510 B1
(45) Date of Patent: Feb. 21, 2012

(54) TALKING ELECTRONIC ASSEMBLY

(76) Inventor: Jay Kamhi, Largo, FL (US)

( * ) Notice: Subject to any disclaimer, the term of this patent is extended or adjusted under 35 U.S.C. 154(b) by 687 days.

(21) Appl. No.: 12/235,993

(22) Filed: Sep. 23, 2008

(51) Int. Cl.
*B43K 29/00* (2006.01)

(52) U.S. Cl. ..... 401/195; 401/52; 401/99; 362/118; 340/692; 379/357.03

(58) Field of Classification Search ..... 401/52, 401/99, 109, 114, 195; 362/118, 184; 340/691.1, 340/692; 379/355.05, 357.03, 361
See application file for complete search history.

(56) References Cited

U.S. PATENT DOCUMENTS 6,158,871 A * 12/2000 Geddes et al. ..... 362/118
6,261,018 B1 * 7/2001 Chen ..... 401/195
6,604,880 B1 * 8/2003 Huang et al. ..... 401/195
6,802,818 B2 * 10/2004 Wang et al. ..... 401/195
7,314,325 B2 1/2008 Chang et al.

* cited by examiner

*Primary Examiner* — Steven J Ganey
(74) *Attorney, Agent, or Firm* — LaMorte & Associates P.C.

(57) ABSTRACT

An electronic assembly that produces audile signals, such as prerecorded phrases, when activated. The electronics assembly is part of a secondary device, such as a pen, utensil, jewelry, or similar small object. The electronics assembly includes a housing having a first end and an opposite second end. A battery casing is disposed within the housing. The battery casing is sized to retain a plurality of concentrically stacked button cell batteries. An electronics module is provided within the housing for producing audible signals. A spring extends from the electronics module into the battery casing and biases the button cell batteries into a stacked configuration. The electronics module is powered, in part, by electricity flow through said spring from the button cell batteries.

13 Claims, 4 Drawing Sheets

TALKING ELECTRONIC ASSEMBLY

BACKGROUND OF THE INVENTION

1. Field of the Invention

In general, the present invention relates to electronic devices that play one of a series of prerecorded phrases when activated. More particularly, the present invention relates to such electronic assemblies encased in a tubular housing, such as a pen housing or a flashlight housing, where batteries are vertically stacked to power the assembly.

2. Prior Art Description

There are many novelty items, such as dolls and stuffed animals, that contain electronics for broadcasting audible messages when activated. The audible messages can be spoken words, phrases, sound effects and/or music.

With advances in microcircuitry, electronic modules capable of broadcasting prerecorded audible messages have become increasingly small. Electronic modules now exist that are so small that they can easily be placed inside small objects such as pens and jewelry. When such electronic modules are placed in a small object, the electronics modules are typically powered with small disc batteries, which are commonly called watch batteries or button cell batteries. In order to obtain the voltage and power needed to operate many electronics module multiple button cell batteries are often used. Typically, the button cell batteries are stacked atop one another in a battery well.

A problem associated with small button cell batteries is that the batteries are disk-shaped, having a diameter that is far larger than the height of the battery. Due to this configuration, button cell batteries cannot be dropped into a battery well in the same manner as traditional cylindrical batteries. If a button cell battery is dropped into a battery well, the button cell battery often turns upside down or lands propped on one edge. Either configuration makes the battery inoperable.

In order to solve this problem, very complex battery compartments have been designed to hold a stack of button cell batteries. For example in German patent disclosure No. 202.19.971.1, a talking pen is disclosed. The electronics within the pen are powered by a stack of button cell batteries. However, the batteries are factory packed in a sealed housing. This prevents the batteries from being replaced. It also prevents the batteries from being recycled or disposed of in an environmentally responsible manner.

In U.S. Pat. No. 7,314,325 to Chang, entitled Pen And Electronic Device Assembly, another talking pen assembly is disclosed. In this assembly, the button cell batteries are held in a specialized battery housing having a removable side access panel. Although the battery housing does permit access to the batteries, access is very complex. The battery housing must first be removed from the assembly. The battery housing must then be opened to reach the batteries. The complexity of the battery chamber makes it unlikely that a user of the product will change the batteries or attempt to remove the batteries prior to disposing the device.

A need therefore exists for an improved design for holding button cell batteries in a stacked configuration in a small electronic device, wherein the batteries are easy to replace, easy to remove and are held in a proper orientation. This need is met by the present invention as described and claimed below.

SUMMARY OF THE INVENTION

The present invention is an electronic assembly that produces audile signals, such as prerecorded phrases, when activated. The electronics assembly is part of a secondary device, such as a pen, utensil, jewelry or similar small object.

The electronics assembly includes a housing having a first end and an opposite second end. A battery casing is disposed within the housing. The battery casing is sized to retain a plurality of concentrically stacked button cell batteries.

An electronics module is provided within the housing producing audible signals. A spring extends from the electronics module into the battery casing and biases the button cell batteries into a stacked configuration. The electronics module is powered, in part, by electricity flow through said spring from the button cell batteries.

A secondary object, such as a necklace chain, writing implement or the like, attaches to the first end of the casing. An activation button extends from the opposite second end of the casing. The activation button is used to selectively activate the electronics module.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be configured as many small handheld objects, such as a bookmark, the present invention is particularly well suited for handheld objects that are generally cylindrical in shape. Accordingly, multiple exemplary embodiments of the present invention are shown. The primary embodiment shows the invention configured as a pen. The secondary embodiment shows that the present invention can be configured as a pendant, spoon, or cosmetic case. Such embodiments are exemplary and are selected merely to set forth some of the best modes contemplated for the invention. Accordingly, the selected exemplary embodiments should not be considered limitations on the scope of the claims.

Figure 1:
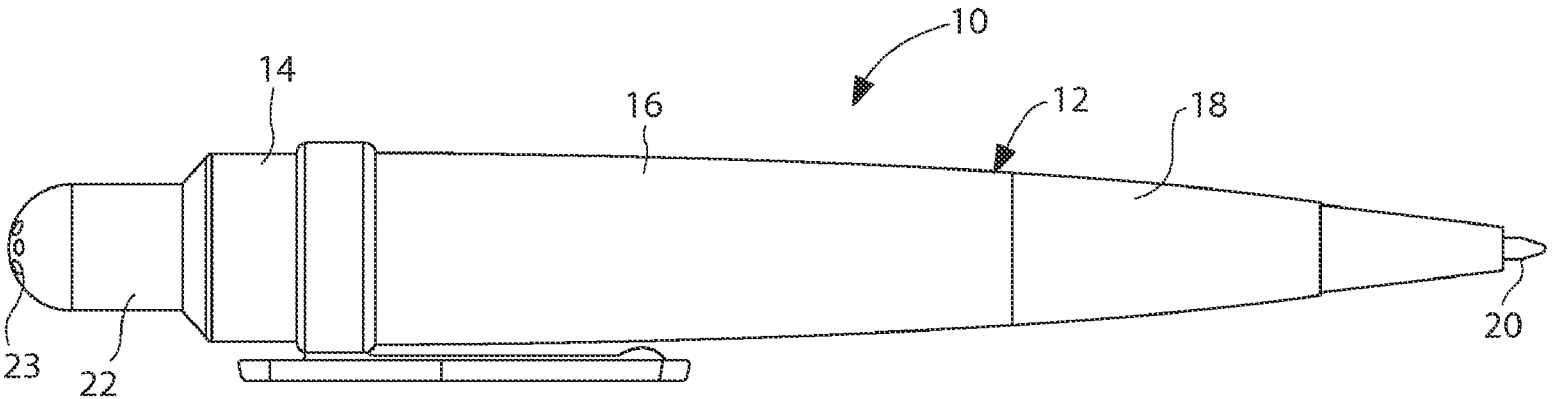
FIG. 1 is a perspective view of an exemplary embodiment of the present invention configured as a talking pen.
Figure 2:
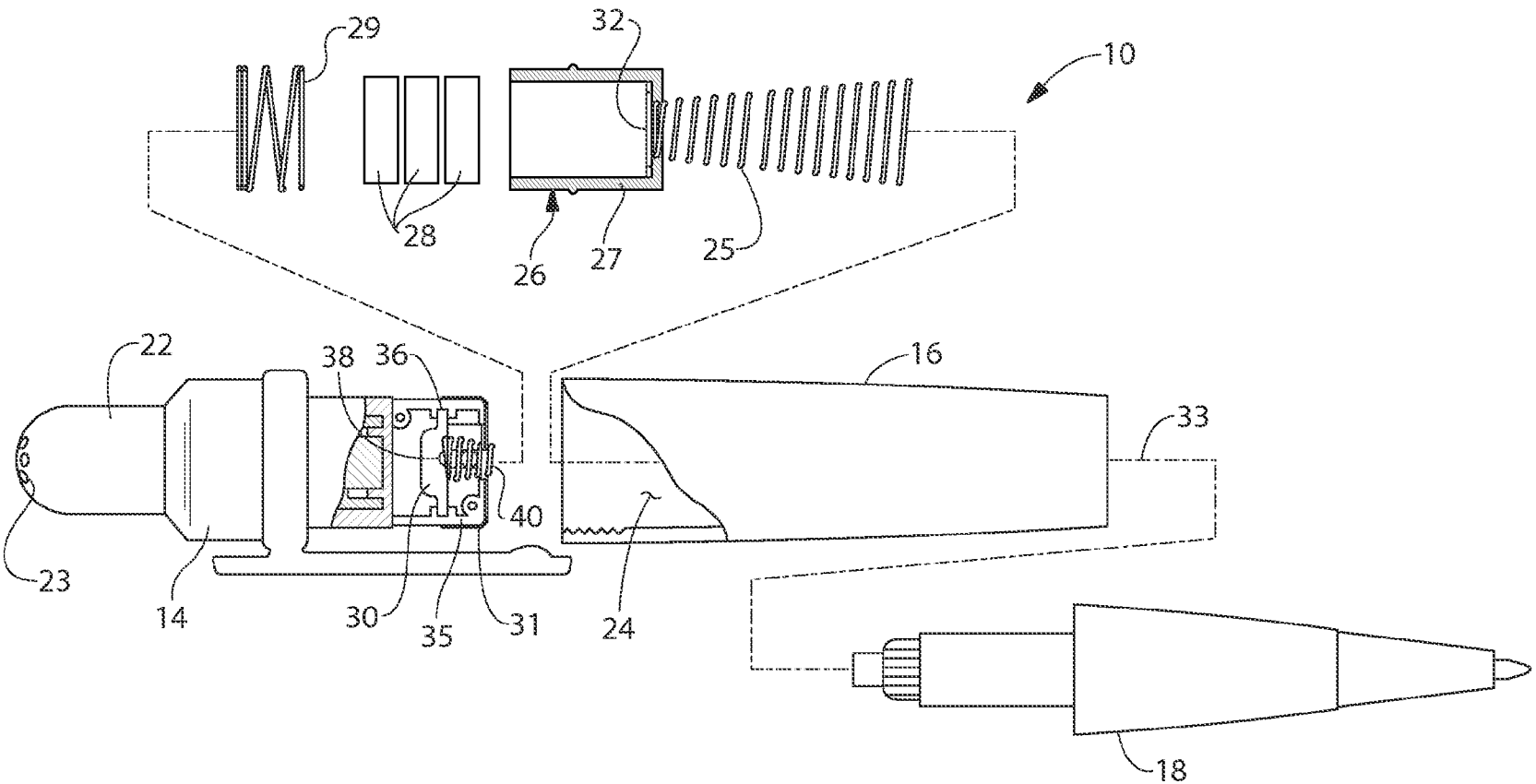
FIG. 2 is a partially exploded view of the embodiment of FIG. 1.
Figure 3:
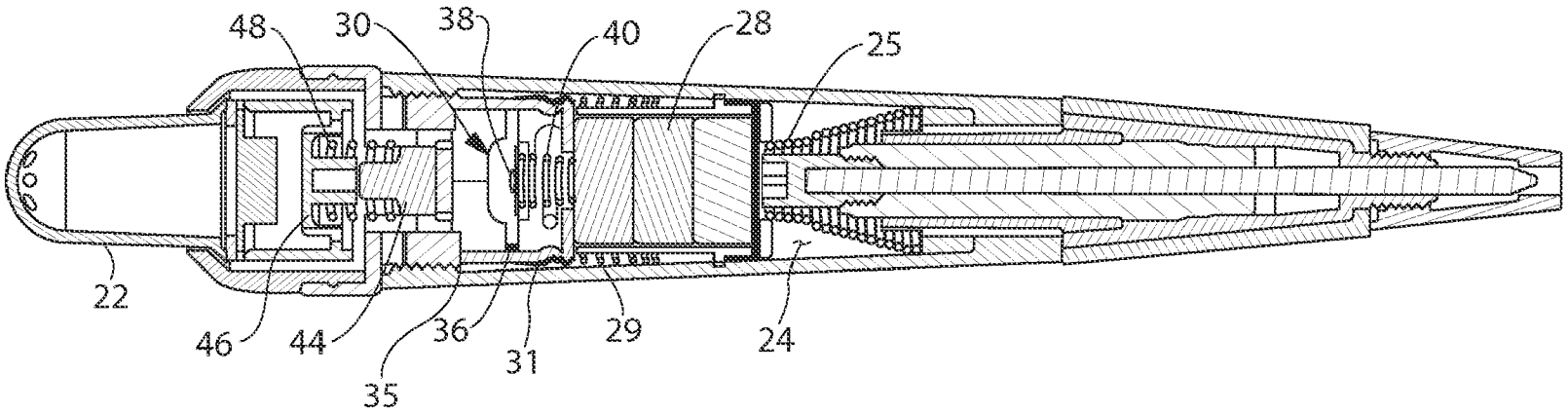
FIG. 3 is a cross-sectional view of the embodiment of FIG. 2.

Referring to FIG. 1 in conjunction with FIG. 2 and FIG. 3, a talking pen assembly 10 is shown. The talking pen assembly 10 has a three-part housing 12 that includes an activator housing section 14, a central housing section 16 and a writing implement housing section 18. The three housing sections 14, 16, 18 mechanically interconnect to form the overall housing 12.

The writing implement housing section 18 holds a pen tip 20 and an ink reserve (not shown). In this manner, the talking pen assembly 10 can function as a pen. It will be understood that the pen tip 20 can be replaced with a felt tip marker point, mechanical pencil point or any other writing implement.

The activator housing section 14 includes a push button 22 that can readily be pressed by a person holding the talking pen assembly 10. An electronics module 30 and the batteries 28 are held within the talking pen assembly 10. When the push button 22 is pressed, the internal electronics module 30 is activated and the electronics module 30 broadcasts an audible signal. The audible signal can be heard emanating out of perforations 23 that are formed in the push button 22.

Referring now solely to FIG. 2, it can be seen that a chamber 24 is provided inside the central housing 16. A battery casing 26 is provided that is sized to fit the chamber 24. The battery casing 26 is defined by a cylindrical wall 27 that is closed at its bottom end by a battery contact 32. The chamber 24 is concentrically disposed around an imaginary axis 33 that extends longitudinally through the center of the talking pen assembly 10.

The battery casing 26 is sized to hold at least three button cell batteries 28 in a stacked configuration. When the battery casing 26 is placed inside the chamber 24, both the battery casing 26 and the stacked configuration are symmetric around the imaginary axis 33. In the shown embodiment, the battery casing 26 is made of a conductive material. The battery contact 32 at the bottom of the battery casing 26 is in electrical contact with the battery casing 26.

A position spring 25 extends below the battery casing 26. The position spring 25 biases the battery casing 26 toward the open end of the chamber 24. However, the position spring 25 allows the battery casing 26 to freely float inside the chamber 24. It will therefore be understood that the battery casing 26 can move reciprocally within the confines of the chamber 24, provided a force is provided that overcomes the bias of the position spring 25.

The position spring 25 extends beyond the bottom of the battery casing 26. At the opposite side of the battery casing 26, a coil spring 29 attaches to the battery casing 26. The coil spring 29 extends beyond the top of the battery casing 26. The coil spring 29 contacts the exterior of the battery casing 26 and extends a short distance beyond the open end of the battery casing 26. The coil spring 29 makes electrical contact with the exterior of the battery casing 26. It will therefore be understood that the battery casing 26, the battery contact 32, and the coil spring 29 all share the same electrical bias.

The electronics module 30 has a peripheral contact 36 and a central contact 38 through which it is powered. The electronics module 30 is powered when the peripheral contact 36 and the central contact 38 are coupled to opposite terminals of the button cell batteries 28. The peripheral contact 36 is located on a peripheral edge of the electronics module 30. The central contact 38 is located in the center of the bottom surface of the electronics module 30, along the central imaginary axis 33. The electronics module 30 is held within a rigid support 35. The rigid support 35 is connected to the activator housing section 14. A conductive band 31 is disposed around the rigid support 33. The peripheral contact 36 of the electronics module 30 is electrically connected to the conductive band 31.

The electronics module 30 contains known circuitry that broadcasts an audible signal when activated.

Referring to FIG. 2 in conjunction with FIG. 3, it can be seen that the central contact 38 of the electronics module 30 is coupled to a spring 40. One end of the spring 40 is affixed to the central contact 38. When assembled, the spring 40 is biased against the stack of button cell batteries 28. This creates a direct electrical connection between the central contact 38 and the stack of button cell batteries 28.

The spring 40, presses against the stack of button cell batteries 28 and biases the button cell batteries 28 against the battery contact 32 at the bottom of the battery chamber 24. Adversely, the position spring 25 biases the battery casing 26 and the button cell batteries 28 upwardly against the spring 40. This ensures good electrical contact on both sides of the stack of button cell batteries 28. It also ensures good contact between the button cell batteries 28 in the stack.

The combined biases of the spring 40 and the position spring 25 ensure that the button cell batteries 28 lay flat in the battery chamber 24 and do not stand on edge.

The activator housing section 14 attaches to the central housing section 16 using a mechanical connection, such as threads. It will therefore be understood that the button cell batteries 28 can be accessed merely by separating the activator housing section 14 from the central housing section 16. Once this is done, the electronics module 30 and spring 40 pull out of the battery chamber 24. The batteries 28 can therefore be simply dumped out of the battery chamber 24. As a consequence, the stack of button cell batteries 28 can be simply installed, removed and replaced.

Referring to FIG. 3, it can be seen, that when assembled, the conductive band 31 surrounding the electronics module 30 contacts the coil spring 29 that protrudes above the battery chamber 24. The conductive band 31 is electrically coupled to the peripheral contact 36 on the electronics module 30. This brings the peripheral contact 36 into direct electrical contact with the bottom of the stack of button cell batteries 28.

An on/off switch 44 is affixed to the electronics module 30. A plunger 46 is disposed atop the on/off switch 44. The plunger 46 is biased away from the on/off switch 44 by a return spring 48. When the push button 22 is manually pressed it pushes the plunger 46 against the on/off switch 44 in opposition of the return spring 48. This activates the on/off switch 44, changing the operational state of the on/off switch 44.

Figure 4:
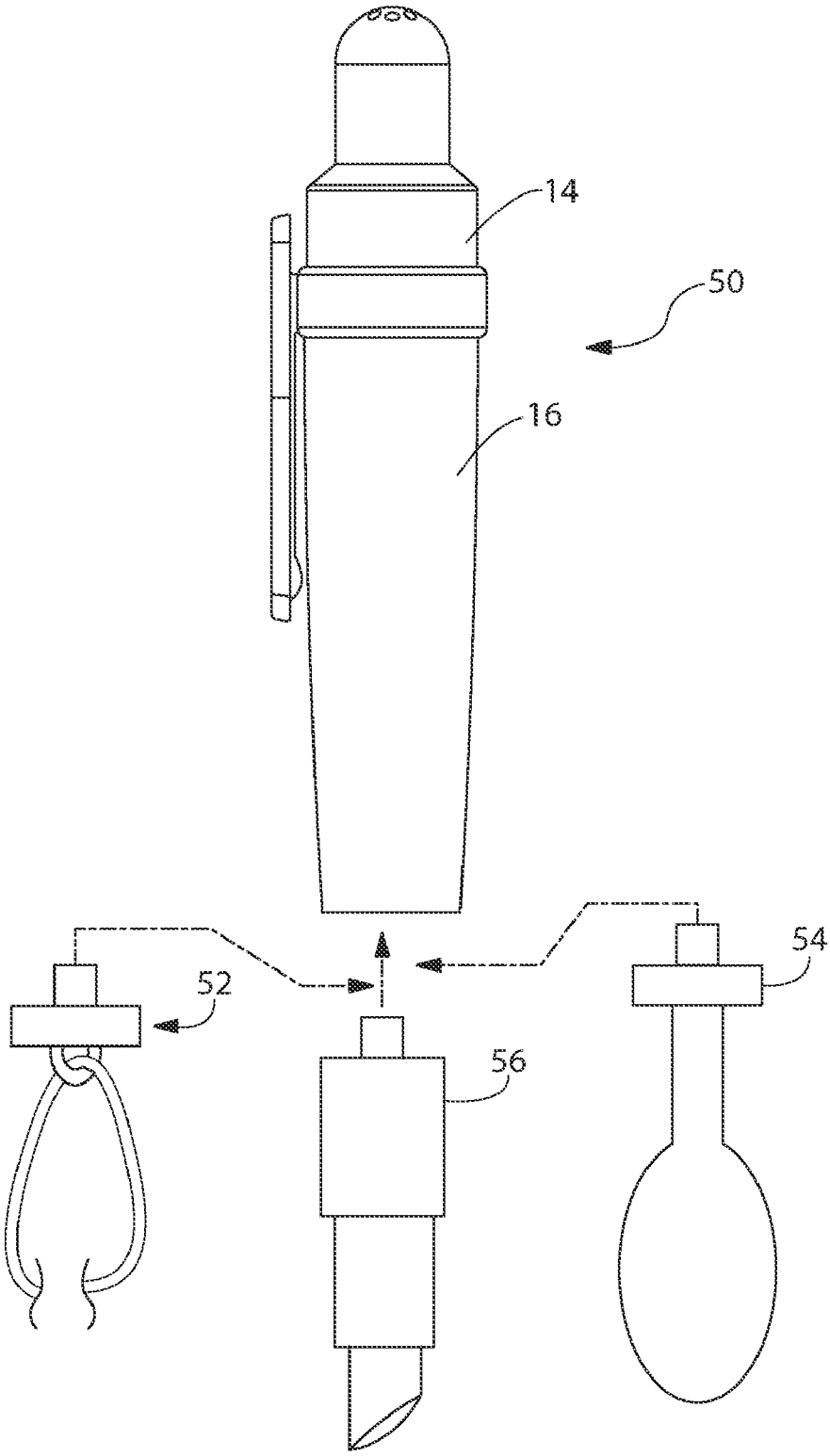
FIG. 4 is a perspective view of an alternate embodiment of the present invention showing optional secondary attachments.

Referring to FIG. 4, the activator housing 14 and central housing 16 are shown assembled into a talking assembly 50. The talking assembly 50 contains the same components and operates in the same manner as has previously been explained. In the embodiment of FIG. 4, there is no writing implement housing. Rather, secondary assemblies are used in place of the writing implement housing. In the shown embodiment, the exemplary secondary assemblies include a necklace attachment 52, a spoon head 54, and a cosmetic container 56 for lip gloss. Each of these secondary assemblies has a connection feature 58, such as threads, that is received and engaged by the talking assembly 50. The talking assembly 50 can therefore be a talking pendent on a necklace, a talking base for a spoon, or the talking base to a cosmetic case.

It will be understood that the embodiments of the present invention that are illustrated are merely exemplary and that a person skilled in the art can make many changes to those embodiments. For instance the shape and size of the casing can be varied as a matter of design choice. Furthermore, many secondary objects, other than have been illustrated, can be attached to the talking assembly. All such variations, modifications and alternate embodiments are intended to be included within the scope of the present invention as defined by the claims.

What is claimed is:

1. An electronic assembly, comprising:

a housing;

a battery casing within said housing that is sized to retain a plurality of concentrically stacked button cell batteries, said battery casing having an open top end and a closed bottom end;

an electronics module within said housing for producing audible signals, wherein said electronics module is positioned over said open top end of said battery casing;

a first spring extending from said electronics module into said battery casing through said open top end, wherein said electronics module is powered, in part, by electricity flow through said spring;

a second spring that extends from said closed bottom end, wherein said battery casing is free floating within said housing between said first spring and said second spring; and an activation button, extending from said housing, for selectively activating said electronics module.

2. The assembly according to claim 1, wherein said first spring, said second spring and said battery casing are concentric with said imaginary central axis.

3. The assembly according to claim 1, wherein said activation button is concentrically positioned around said imaginary central axis.

4. The assembly according to claim 3, wherein said electronics module is interposed between said first spring and said activation button.

5. The assembly according to claim 1, wherein said electronics module has a first terminal and a second terminal for receiving electricity.

6. The assembly according to claim 5, wherein said first spring is affixed to said first terminal.

7. The assembly according to claim 5, further including a battery contact within said battery casing, wherein said battery contact is electrically connected to said second terminal on said electronics module.

8. The assembly according to claim 7, wherein said battery casing includes a casing wall, wherein said casing wall is conductive and is part of an electrical interconnection between said second terminal to said battery contact.

9. The assembly according to claim 8, further including a third spring that electrically interconnects said battery casing to said second terminal.

10. The assembly according to claim 1, further including a secondary object connected to said casing, wherein said secondary object is selected from a group consisting of writing implements, jewelry, utensils and cosmetic containers.

11. A talking pen assembly, comprising;

a housing having a first end and an opposite second end;

a plurality of button cell batteries disposed in a battery casing within said housing, wherein said button cell batteries are oriented in a concentric stacked configuration;

an electronics module within said housing for producing audible signals;

a first spring extending from said electronics module toward said button cell batteries, wherein said first spring biases said button cell batteries into said stacked configuration, and wherein electricity flows through said first spring from said button cell batteries;

a second spring that extends from said battery casing, wherein said battery casing is free floating within said housing between said first spring and said second spring;

a writing implement protruding from said first end of said casing; and an activation button protruding from said second end of said casing for selectively activating said electronics module.

12. The assembly according to claim 11, wherein said battery casing includes a casing wall, wherein said casing wall is conductive and forms part of an electrical interconnection between said electronics module to contact.

13. The assembly according to claim 12, further including a third spring that electrically interconnects said battery casing and forms part of said electrical interconnection.

* * * * *